US012085093B2

(12) United States Patent
Manninen

(10) Patent No.: US 12,085,093 B2
(45) Date of Patent: Sep. 10, 2024

(54) SYSTEMS AND METHODS FOR REMOVING LIQUIDS FROM THE SURFACE OF A NON-POROUS MATERIAL

(71) Applicant: John Manninen, Paradise, CA (US)

(72) Inventor: John Manninen, Paradise, CA (US)

( * ) Notice: Subject to any disclaimer, the term of this patent is extended or adjusted under 35 U.S.C. 154(b) by 131 days.

(21) Appl. No.: 17/896,723

(22) Filed: Aug. 26, 2022

(65) Prior Publication Data

US 2024/0068490 A1 Feb. 29, 2024

(51) Int. Cl.

| | |
|---|---|
| ***F04F 10/00*** | (2006.01) |
| ***E04H 4/14*** | (2006.01) |
| *E04H 4/10* | (2006.01) |

(52) U.S. Cl.

CPC ..... *F04F 10/00* (2013.01); *E04H 4/14* (2013.01); *E04H 4/10* (2013.01)

(58) Field of Classification Search

CPC ..... F04F 10/00; E04H 4/14; E04H 4/10
See application file for complete search history.

(56) References Cited

U.S. PATENT DOCUMENTS 4,059,126 A * 11/1977 Nickerson ..... E04D 13/0404 137/142
4,830,040 A * 5/1989 Eng ..... E04H 4/10 137/448
5,343,888 A 9/1994 Stelzer
6,945,267 B1 9/2005 Tedona

OTHER PUBLICATIONS

Swimline; "CoverSaver"; webpage; located at https://swimline.com/products/cover-saver-non-electricsiphon-pump-parts-5436; accessed on Aug. 25, 2022.

* cited by examiner

*Primary Examiner* — P. Macade Nichols
(74) *Attorney, Agent, or Firm* — Maschoff Brennan

(57) ABSTRACT

Systems and methods for removing liquids from the surface of a non-porous material are provided. In one system, a dual-chambered siphon device includes a first lower chamber having at least one inlet that allows liquid from a surface of a pool cover to enter the first lower chamber, a float positioned within the first lower chamber that is configured to change a position within the first lower chamber based on a level of liquid within the first lower chamber, a second upper chamber that is in fluid communication with the first lower chamber, and a flap valve that is actuated by the float. The flap valve may be configured to seal an outlet in the second upper chamber when the flap valve is in a closed position and unseal the outlet in the second upper chamber when the flap valve is in an open position.

8 Claims, 4 Drawing Sheets

SYSTEMS AND METHODS FOR REMOVING LIQUIDS FROM THE SURFACE OF A NON-POROUS MATERIAL

BACKGROUND

There currently exist a number of systems that can assist in the removal of liquids from a nonporous surface, such as a pool cover. Some of these systems rely on electricity. Other systems use a siphon. Still other systems use a drain effect.

Each of these systems can be improved. For example, systems that use electricity are not reliable and can be dangerous. Systems that use a syphon are often difficult to initiate and require outside force every time the siphon is initiated. Systems that use a drain effect may require extensive work to install, including puncturing the nonporous surface.

The subject matter claimed in the present disclosure is not limited to embodiments that provide any of the advantages or solve any of the disadvantages described above.

SUMMARY

In one embodiment, a dual-chambered device for removing liquids from a nonporous surface is provided. The dual-chambered device may include a first lower chamber having at least one inlet, the at least one inlet being configured to allow liquid from a surface of a nonporous material to enter the first lower chamber; a float positioned within the first lower chamber, the float being configured to change a position within the first lower chamber based on a level of liquid within the first lower chamber; a second upper chamber that is in fluid communication with the first lower chamber, the second upper chamber being configured to retain an amount of liquid; and a flap valve that is configured to be actuated by the float, wherein the flap valve is configured to seal an outlet in the second upper chamber when the flap valve is in a closed position and unseal the outlet in the second upper chamber when the flap valve is in an open position.

In some embodiments, the at least one inlet may include a filter that prevents nonliquid materials from entering the first lower chamber.

In some embodiments, the first lower chamber may be in fluid communication with the second upper chamber through a pipe that delivers liquid from the first lower chamber to the second upper chamber when a pressure in the second upper chamber drops. In these embodiments, the drop in pressure in the second upper chamber may be created when the flap valve is in an open position and the liquid in the second upper chamber is released.

In some embodiments, the float may be configured to open the flap valve when the level of liquid in the first lower chamber is at or exceeds a determined level. The float may be configured to close the flap valve when the level of liquid in the first lower chamber does not exceed the determined level.

In some embodiments, the second upper chamber may be made from a transparent material so that the amount of liquid retained in the second upper chamber may be observed from outside the dual-chambered device.

In another embodiment, a siphoning device for collecting and removing liquid from a pool cover is provided. The siphoning device may include an enclosure having a top portion and a bottom portion, wherein the bottom of the enclosure is configured to allow liquid from a surface of a pool cover to enter the enclosure through one or more inlets and the top portion of the enclosure includes a hole that is configured to discharge liquid from within the enclosure through a siphoning action; and one or more support arms secured to the enclosure that extend away from the enclosure to maintain the enclosure in an upright position and to create channels through which liquid from the surface of the pool cover is directed toward the enclosure.

In some embodiments, the enclosure may include a first lower chamber in the bottom portion and a second upper chamber in the top portion that are in fluid communication through a tube. During a siphoning action, the tube may be configured to deliver liquid from the lower chamber to the upper chamber of the enclosure. In these embodiments, the second upper chamber may be configured to retain an amount of liquid that acts as a weight to create a depression in the pool cover and that attracts liquid from the surface of the pool cover.

In some embodiments, the first lower chamber may include a float, and the second upper chamber may include a flap valve that is configured to be actuated by the float and to seal the hole when the flap valve is in a closed position. In these embodiments, the amount of liquid retained in the second upper chamber may be configured to initiate the siphoning action when the flap valve is opened.

In yet another embodiment, a system for removing liquids from a pool cover is provided. The system may include a dual-chambered siphon device including: a first lower chamber having at least one inlet, the at least one inlet being configured to allow liquid from a surface of a pool cover to enter the first lower chamber, a float positioned within the first lower chamber, the float being configured to change a position within the first lower chamber based on a level of liquid within the first lower chamber, a second upper chamber that is in fluid communication with the first lower chamber, the second upper chamber being configured to retain an amount of liquid, and a flap valve that is configured to be actuated by the float, wherein the flap valve is configured to seal an outlet in the second upper chamber when the flap valve is in a closed position and unseal the outlet in the second upper chamber when the flap valve is in an open position. The system may also include a hose having a first end and a second end, the first end of the hose being connected to the outlet in the second upper chamber of the dual-chambered siphon device and the second end of the hose terminating at an elevation that is lower than the elevation of the dual-chambered device.

In some embodiments, the amount of liquid retained in the second upper chamber may be sufficient to initiate a siphon action when the flap valve is moved into an open position.

In some embodiments, the system may further include one or more support arms secured to the dual-chambered siphon device that extend away from the dual-chambered siphon device to maintain the dual-chambered siphon device in an upright position and create channels through which liquid from the surface of the pool cover is directed toward the dual-chambered siphon device.

It is to be understood that both the foregoing summary and the following detailed description are explanatory and are not restrictive of the invention as claimed.

BRIEF DESCRIPTION OF THE DRAWINGS

Embodiments will be described and explained with additional specificity and detail through the use of the accompanying drawings in which.

DETAILED DESCRIPTION

Figure 1:
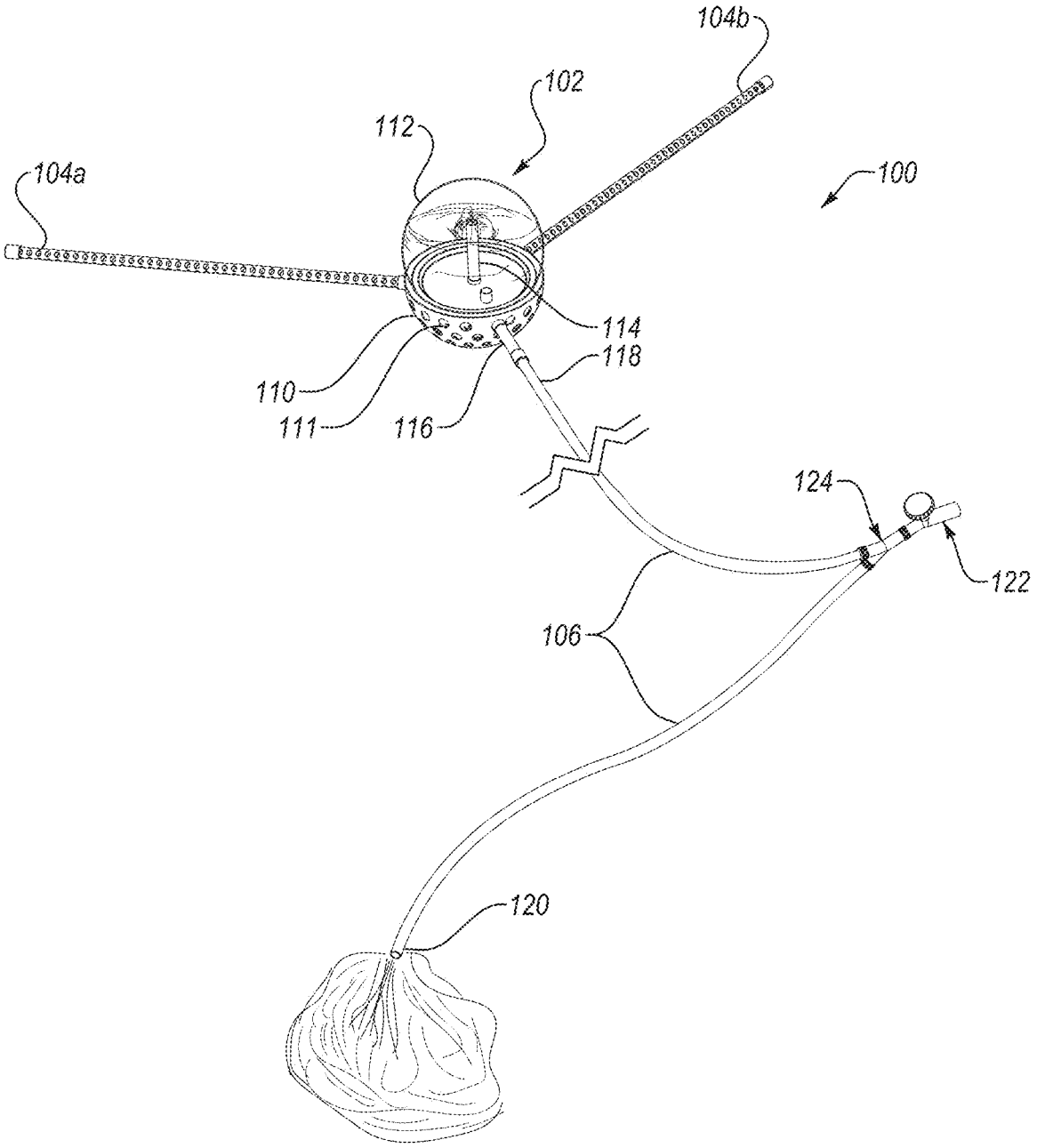
FIG. 1 illustrates an example system configured for removing liquids from a non-porous surface.

There currently exist a number of systems that can assist in the removal of liquids from a nonporous surface, such as a pool cover. Some of these systems require electricity. However, electricity is not always reliable, especially during weather events, such as storms, which is when the removal of liquid from some surfaces is most needed. Additionally, it can be dangerous to use electrical mechanisms outdoors and in wet environments, especially if the liquid is flammable. Additionally, many of the electrical mechanisms in these systems use motor driven impellers, which can cause physical damage if they come in contact with the nonporous surface.

Other systems use a siphon to remove liquids from a surface. However, many of these systems require a hand pump or other device to initiate the siphon. Initiating the siphon is not only time consuming and difficult, these systems often require an outside force to initiate the siphon every time a liquid is to be removed from the surface.

Still other systems use a drain effect, which requires extensive work installing the device prior to use, including puncturing the nonporous surface and attaching plumbing fittings and reconfiguring sidewall plumbing, which then must be reversed when no longer needed, such as at the end of a rainy season. Furthermore, these systems do not attract liquids towards the drain using the effect of weight. And unfortunately, they cannot be repositioned to different parts of the surface.

Other disadvantages of current systems involve weight. The weight of current systems is often fixed and cannot be advantageously increased or decreased depending on a specific need. A device that is heavy enough to attract liquids may be difficult to position during installation and may cause damage to some surfaces. A device that is too light may not be useful in a syphon system as the device may allow an opening to contact air, thereby breaking the siphon and ending the process. Additionally, a device that is too light will not create a depression in the surface that attracts liquids for removal.

Therefore, it would be desirable to have a device that removes liquids such as rainwater from a nonporous surface through a fundamental siphon effect. Furthermore, it would be desirable to have a device that is weighted down at an inlet to maintain that siphon for as long as possible. Furthermore, it would be desirable to have a device that, due to the weight of the liquid in a storage area, it attracts liquid from adjacent areas. Thus, there currently exists a need in the industry for a device that is easy to use, install, and remove, and that requires no electricity to remove liquid from a nonporous surface, such as a pool cover. There also currently exists a need in the industry for a process that very quickly and easily starts a siphon, maintains the inlet at the best possible location, and attracts more liquids towards the opening.

Some embodiments disclosed herein may enable the removal of liquids from a porous surface. In particular, a system for removing liquids from a non-porous surface, according to the present disclosure, may include a dual-chambered siphon device including: a first lower chamber having at least one inlet, the at least one inlet being configured to allow liquid from a surface of a pool cover to enter the first lower chamber, a float positioned within the first lower chamber, the float being configured to change a position within the first lower chamber based on a level of liquid within the first lower chamber, a second upper chamber that is in fluid communication with the first lower chamber, the second upper chamber being configured to retain an amount of liquid, and a flap valve that is configured to be actuated by the float, wherein the flap valve is configured to seal an outlet in the second upper chamber when the flap valve is in a closed position and unseal the outlet in the second upper chamber when the flap valve is in an open position. The system may also include a hose having a first end and a second end, the first end of the hose being connected to the outlet in the second upper chamber of the dual-chambered siphon device and the second end of the hose terminating at an elevation that is lower than the elevation of the dual-chambered device.

Turning to the figures, FIG. 1 illustrates an example system 100 configured for removing liquids from a non-porous surface. System 100 may include a siphon device 102, support arms 104*a*-104*b*, and a hose 106. Siphon device 102 may be positioned on top of a non-porous material (not shown) and may be configured to remove a liquid from the surface of the non-porous material through the hose 106. A siphon action may be used to remove the liquid from the non-porous surface.

In some embodiments, siphon device 102 may be a dual-chambered device having a first lower chamber 110 and a second upper chamber 112. Liquid from the non-porous surface may enter the first lower chamber 110 through one or more inlets 111. The first lower chamber 110 and the second upper chamber 112 may be in fluid communication. For example, a tube 114 may extend between the first lower chamber 110 and the second upper chamber 112 allowing liquid collected in the first lower chamber 110 to be delivered to the second upper chamber 112.

The second upper chamber 112 may be in fluid communication with an outlet 116 that is configured to remove liquid collected within the second upper chamber 112. This outlet 116 may be secured either directly or indirectly to a first end 118 of the hose 106. A second end 120 of hose 106 may terminate at an elevation that is lower than the elevation of the siphon device 102, thereby creating a siphon effect when the siphon device 102 has been primed.

To prime the siphon device 102, a liquid may be delivered to the second upper chamber 112 as well as all or a portion of the hose 106. In one embodiment, this liquid may be delivered to the second upper chamber and/or the hose 106 through the outlet 116. For example, a liquid under pressure may be connected to hose 106. This pressurized liquid may be introduced to the hose 106 at connection point 122. The connection point 122 may include an adapter to which a pressurized liquid may be attached as well as a junction valve 124.

The junction valve 124, which could be configured as a Y fitting or a T fitting or another type of fitting, may be in selective fluid communication with one or both of first and second ends 118 and 120 of the hose 106. The junction valve 124 may be configurable to close access to portions of the hose 106 and/or the connection point 122. For example, in a first configuration, the junction valve 124 may close access to the second end 120 of the hose 106 but allow a liquid to flow between the connection point 122 and the first end 118. This configuration may be desirable when priming the siphon by adding a liquid to the second upper chamber 112 of the siphon device 102 though a pressurized liquid source, which is connected at connection point 122.

In another configuration, the junction valve 124 may close access to the connection point 122 while allowing liquid to flow from the first end 118 to the second end 120 of the hose 106. This configuration may be desirable after the siphon device 102 has been primed and a liquid has been delivered to the second upper chamber 112 of the siphon device 102.

The hose 106 may include an in-line air trap (not shown), sometimes called a "P" trap, that is configured to prevent air from entering the hose 106. Retaining liquid in all or part of the hose 106 may assist in initiating the siphon action.

The support arms 104*a*-104*b* may serve a variety of functions. First, the support arms 104*a*-104*b* may provide lateral support to the siphon device 102 in order to maintain the siphon device 102 in an upright orientation (with second upper chamber 112 above the first lower chamber 110). Any number of support arms may be included in order to maintain the siphon device 102 in an upright position and they may be spaced apart in any orientation. For example, in the system 100, the support arms 104*a* and 104*b* are separated by approximately 120°.

In addition to providing lateral support, the support arms 104*a*-104*b* may also contribute to the delivery of liquid from the surface of the non-porous material to the siphon device 102. For example, the support arms 104*a*-104*n* may be hollow and include perforations that allow liquid to enter the support arms 104*a*-104*b* and be directed to the first lower chamber 110. The hollow support arms 104*a*-104*b* may terminate at an inlet 111 in the first lower chamber 110 such that any liquid within the support arms 104*a*-104*b* is delivered directly into the first lower chamber 110 of the siphon device 102. In addition, the support arms 104*a* and 104*b* may create creases in the surface of the non-porous material that may also channel a liquid on the surface of the non-porous material toward the siphon device 102.

Modifications, additions, or omissions may be made to the system 100 without departing from the scope of the present disclosure. For example, in some embodiments, the system 100 may include additional components similar to the components illustrated in FIG. 1 that each may be configured similarly to the components illustrated in FIG. 1. For example, in some embodiments, a siphon device (such as the device shown in FIG. 2) may further include a float and flap valve that selectively starts and stops the siphon action.

Figure 2:
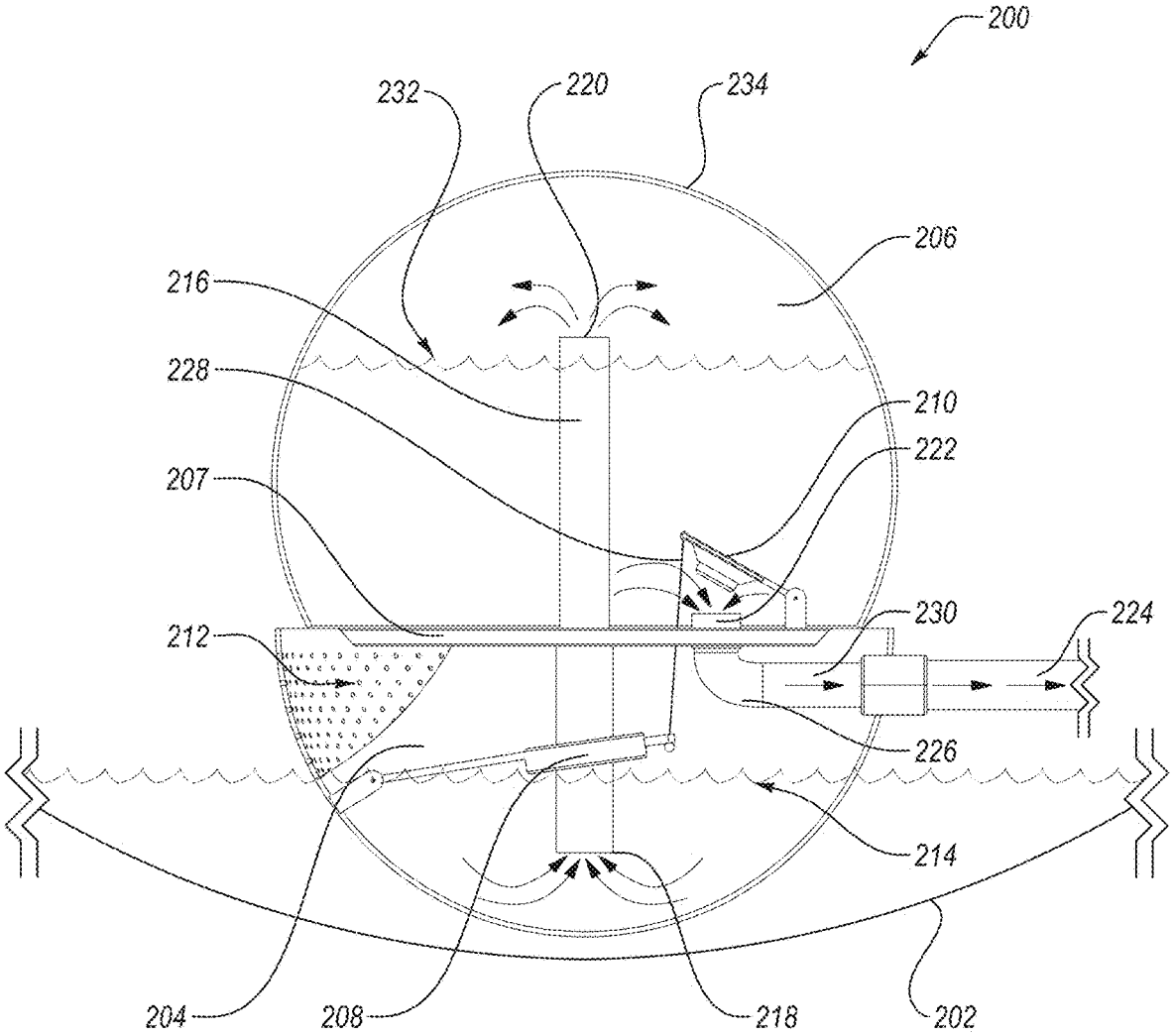
FIG. 2 illustrates a cross-sectional view of an example siphon device.

FIG. 2 illustrates a cross-sectional view of an example siphon device 200, which is positioned on a non-porous surface 202. Siphon device 200 may include a first lower chamber 204 and a second upper chamber 206, which are separated by a partition 207. The siphon device 200 may also include a float 208 within the first lower chamber 204, and a flap valve 210 within the second upper chamber 206. The first lower chamber may include one or more inlets (not shown) that allow a liquid from the non-porous surface 202 to enter the first lower chamber 204. The first lower chamber may also include a filter 212 that is configured to prevent nonliquid materials from entering the first lower chamber 204. In one embodiment, the filter 212 is a mesh screen.

The flap valve 210 may be configured to selectively seal an outlet 222 in the second upper chamber 206. In one embodiment, the flap valve 210 may be pivotally attached to an inner surface of the second upper chamber 206. In a first closed position, the flap valve 210 may cover and seal the outlet 222 preventing any liquid contained within the second upper chamber 206 from escaping through the outlet 222. In a second open position, the flap valve 210 may not cover or seal the outlet 222, thereby allowing any liquid contained within the second upper chamber 206 to escape out of the second upper chamber 206.

The first lower chamber 204 may be in fluid communication with the second upper chamber 206 through a tube 216. A bottom end 218 of the tube 216 may terminate within the first lower chamber 204 and a top end 220 of the tube 216 may terminate within the second upper chamber 206.

In one embodiment, the outlet 222 may be connected to a hose 224, which may terminate at an opposite end that is lower in elevation than the bottom end 218 of the tube 216 such that a siphon effect may be achieved. The connection between the hose 224 and the outlet 222 may be direct or indirect. For example, in the siphon device 200, the hose 224 is connected to the outlet 222 indirectly through an elbow joint 230.

The float 208 may be configured to change a position within the first lower chamber 204 based on a level of liquid 214 within the first lower chamber. In one embodiment, the float may be pivotally attached to an inner surface of the first lower chamber 204 such that the float can move up and down within the first lower chamber 204 with the level of liquid 214.

A lever 228 may mechanically attach the float 208 to the flap valve 210 such that movement of the float 208 may cause the flap valve 210 to move between the first closed position, in which the flap valve 210 seals the outlet 222, and the second open position, in which the flap valve 210 does not the outlet 222. In some embodiments, a determined level may be established such that when the level of liquid 214 is at or above the determined level, the float may cause the flap valve 210 to be in the second open position. In this embodiment, when the level of liquid 214 is below the determined level, the float may cause the flap valve 210 to be in the first closed position. In this embodiment, the bottom end 218 of the tube 216 may terminate at a level that is below the determined level.

In alternative embodiments, a device other than a float may be used to determine whether the level of liquid 214 is at or above the determined level. For example, the level of liquid 214 in the first lower chamber 204 may be determined by an electronic or other type of sensor.

The siphon device 200 may be primed by filling the second upper chamber 206 with a liquid. The level of liquid 232 in the second upper chamber 206 may be at or just below the top end 220 of the tube 216 such that liquid does not fall through the tube 216 and into the first lower chamber 204. The liquid held in the second upper chamber 206 may be sufficient to create a siphon effect when the flap valve 210 is opened and the opposite end of the hose 224 is at an elevation that is lower than the bottom end 218 of the tube 216.

In some embodiments, the material 234 used to enclose the second upper may be, in whole or in part, transparent. This may allow the level of liquid 232 contained within the second upper chamber 206 to be seen from the outside. The level of liquid 232 within the second upper chamber 206 may dictate whether the device is or is not primed and whether the device is actively siphoning out liquid. Further, the liquid held in the second upper chamber 206 may act as a weight that creates a depression in the non-porous surface 202 and that attracts liquid from the surface to the siphon device 200.

Modifications, additions, or omissions may be made to the siphon device 200 without departing from the scope of the present disclosure. For example, in some embodiments, the siphon device 200 may include additional components similar to the components illustrated in FIG. 2 that each may be configured similarly to the components illustrated in FIG. 2.

Figure 3:
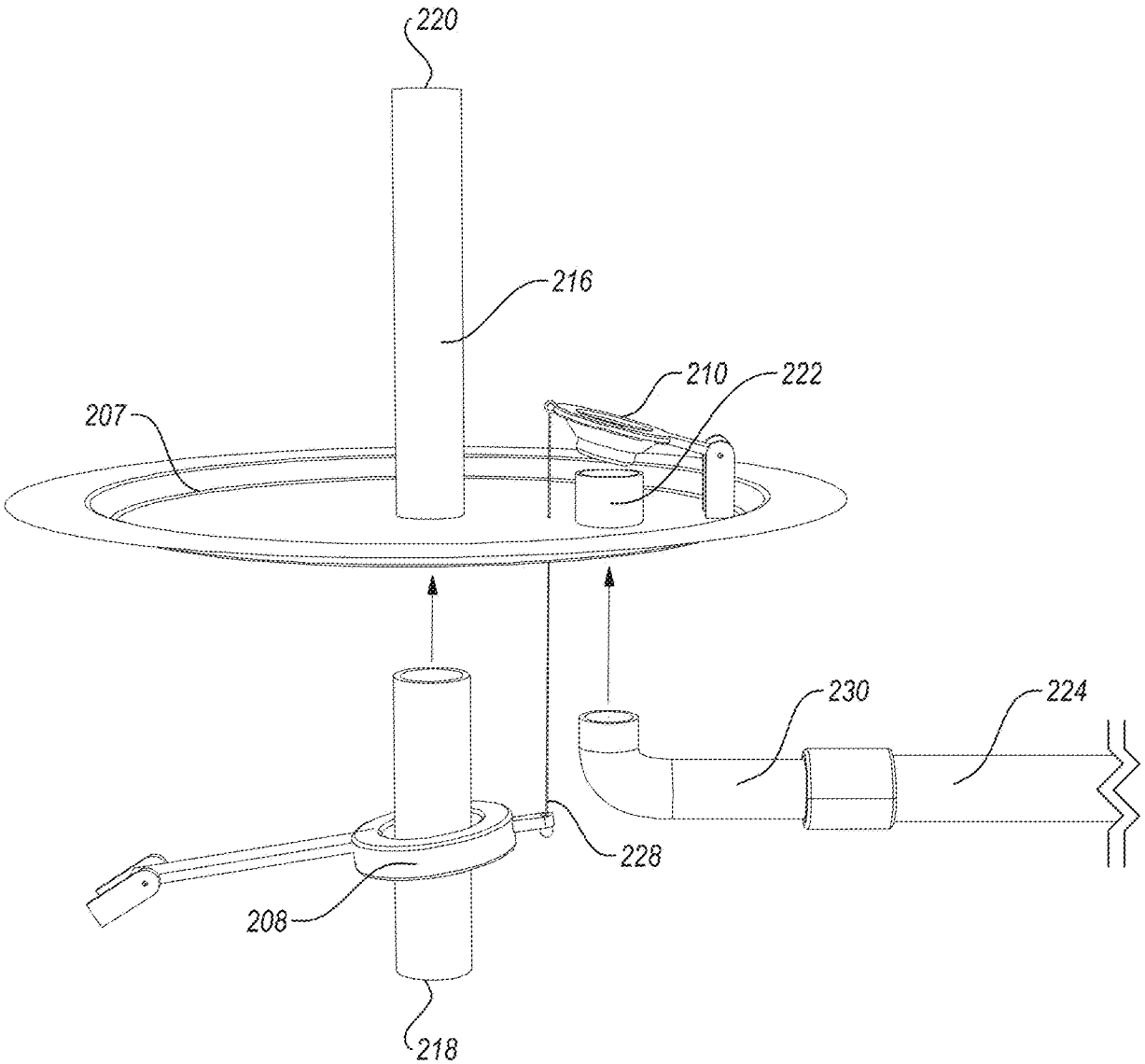
FIG. 3 illustrates an exploded perspective view of some components of the example siphon device of FIG. 2.

FIG. 3 illustrates an exploded perspective view of some components of the example siphon device of FIG. 2. For example, the tube 216 (that connects the first lower chamber 204 and the second upper chamber 206, which are not shown) includes the top end 220 and the bottom end 218. The partition 207 includes a rim that forms a raised perimeter on the partition. However, in other embodiments the partition 207 may be flat or have another shape or contours. The lever 228 that connects the float 208 to the flap valve 210 is also shown. In addition, the elbow joint 230 that connects the outlet 222 to the hose 224 is also shown.

Figure 4:
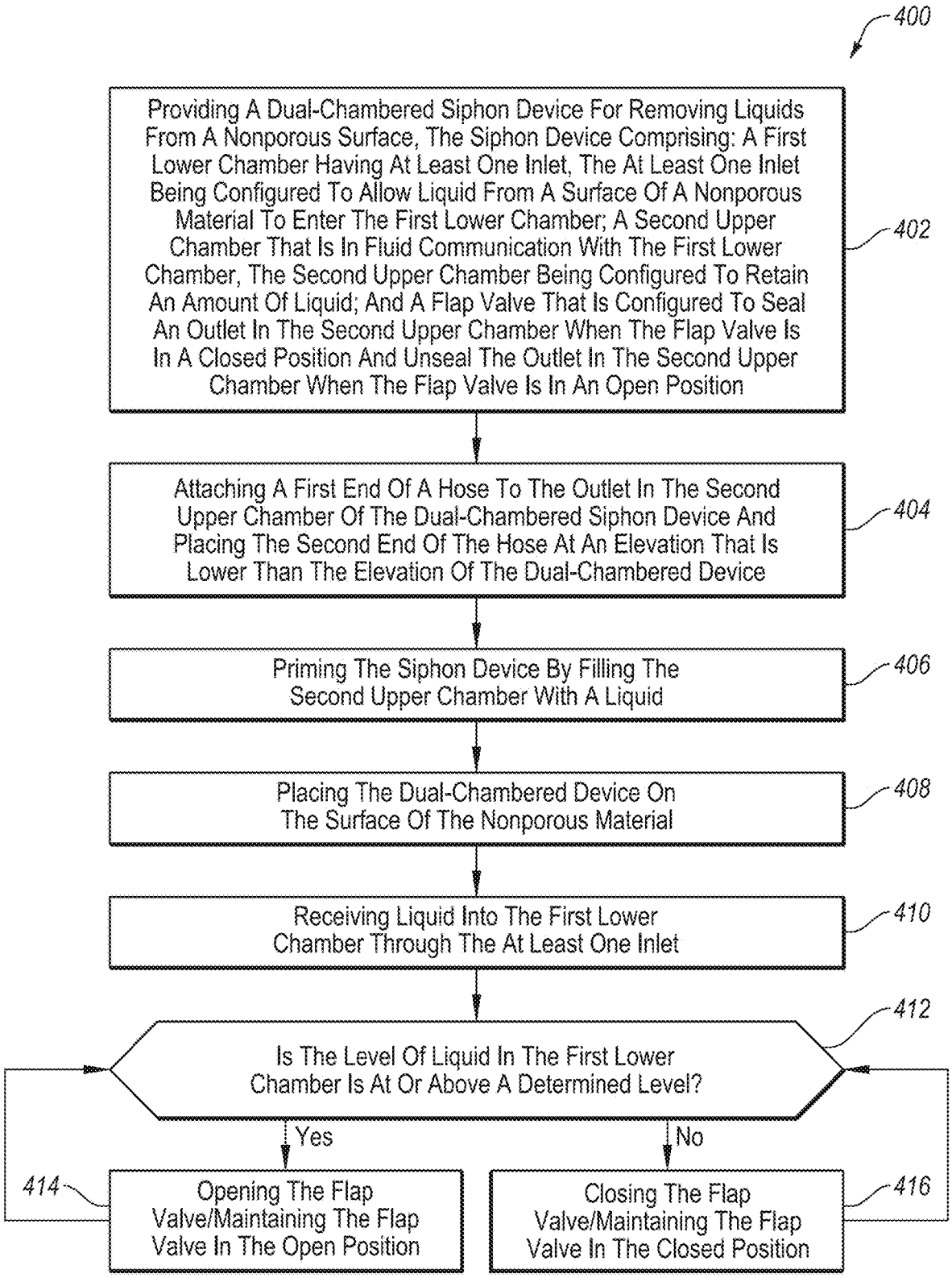
FIG. 4 is a flowchart of an example method for removing liquids from a non-porous surface.

FIG. 4 is a flowchart of an example method 400 for removing liquids from a non-porous surface. The method 400 may be performed, in some embodiments, by a device or system, such as by the system 100 of FIG. 1. The method 400 will now be described in connection with FIGS. 1, 2, 3, and 4.

The method 400 may include, at action 402, providing a dual-chambered siphon device for removing liquids from a nonporous surface, the siphon device comprising: a first lower chamber having at least one inlet, the at least one inlet being configured to allow liquid from a surface of a nonporous material to enter the first lower chamber; a second upper chamber that is in fluid communication with the first lower chamber, the second upper chamber being configured to retain an amount of liquid; and a flap valve that is configured to seal an outlet in the second upper chamber when the flap valve is in a closed position and unseal the outlet in the second upper chamber when the flap valve is in an open position. For example, the siphon device may be the siphon device 200 illustrated in FIG. 2.

The method 400 may include, at action 404, attaching a first end of a hose to the outlet in the second upper chamber of the dual-chambered siphon device and placing the second end of the hose at an elevation that is lower than the elevation of the dual-chambered device. The first end of the hose may be directly or indirectly attached to the outlet in the second upper chamber of the dual-chambered siphon device.

The method 400 may include, at action 406, priming the siphon device by filling the second upper chamber with a liquid. In addition to the second upper chamber, the hose may also be filled with and retain the liquid. For example, in some embodiments, the hose may include an in-line air trap to maintain the liquid in the hose.

The method 400 may include, at action 408, placing the dual-chambered device on the surface of the nonporous material and, at action 410, receiving liquid into the first lower chamber through the at least one inlet.

The method 400 may include, at action 412, determining whether the level of liquid in the first lower chamber is at or above a determined level. If the level of liquid in the first lower chamber is at or above the determined level, the method 400 may include, at action 414 opening the flap valve/maintaining the flap valve in the open position. Alternatively, if the level of liquid in the first lower chamber is below the determined level, the method 400 may include, at action 416, closing the flap valve/maintaining the flap valve in the closed position.

In accordance with common practice, the various features illustrated in the drawings may not be drawn to scale. The illustrations presented in the present disclosure are not meant to be actual views of any particular apparatus (e.g., device, system, etc.) or method, but are merely example representations that are employed to describe various embodiments of the disclosure. Accordingly, the dimensions of the various features may be arbitrarily expanded or reduced for clarity. In addition, some of the drawings may be simplified for clarity. Thus, the drawings may not depict all of the components of a given apparatus (e.g., device) or all operations of a particular method.

Terms used herein and especially in the appended claims (e.g., bodies of the appended claims) are generally intended as "open" terms (e.g., the term "including" should be interpreted as "including, but not limited to," the term "having" should be interpreted as "having at least," the term "includes" should be interpreted as "includes, but is not limited to," etc.).

Additionally, if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations.

In addition, even if a specific number of an introduced claim recitation is explicitly recited, it is understood that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." or "one or more of A, B, and C, etc." is used, in general such a construction is intended to include A alone, B alone, C alone, A and B together, A and C together, B and C together, or A, B, and C together, etc. For example, the use of the term "and/or" is intended to be construed in this manner.

Further, any disjunctive word or phrase presenting two or more alternative terms, whether in the summary, detailed description, claims, or drawings, should be understood to contemplate the possibilities of including one of the terms, either of the terms, or both terms. For example, the phrase "A or B" should be understood to include the possibilities of "A" or "B" or "A and B."

Additionally, the use of the terms "first," "second," "third," etc., are not necessarily used herein to connote a specific order or number of elements. Generally, the terms "first," "second," "third," etc., are used to distinguish between different elements as generic identifiers. Absent a showing that the terms "first," "second," "third," etc., connote a specific order, these terms should not be understood to connote a specific order. Furthermore, absent a showing that the terms "first," "second," "third," etc., connote a specific number of elements, these terms should not be understood to connote a specific number of elements. For example, a first widget may be described as having a first side and a second widget may be described as having a second side. The use of the term "second side" with respect to the second widget may be to distinguish such side of the second widget from the "first side" of the first widget and not to connote that the second widget has two sides.

The foregoing description, for purpose of explanation, has been described with reference to specific embodiments. However, the illustrative discussions above are not intended to be exhaustive or to limit the invention as claimed to the precise forms disclosed. Many modifications and variations are possible in view of the above teachings. The embodiments were chosen and described to explain practical applications, to thereby enable others skilled in the art to utilize the invention as claimed and various embodiments with various modifications as may be suited to the particular use contemplated.

The invention claimed is:

1. A dual-chambered device for removing liquids from a nonporous surface, the device comprising:

a first lower chamber having at least one inlet, the at least one inlet being configured to allow liquid from a surface of a nonporous material to enter the first lower chamber;

a float positioned within the first lower chamber, the float being configured to change a position within the first lower chamber based on a level of liquid within the first lower chamber;

a second upper chamber that is in fluid communication with the first lower chamber, the second upper chamber being configured to retain an amount of liquid; and a flap valve that is configured to be actuated by the float, wherein the flap valve is configured to seal an outlet in the second upper chamber when the flap valve is in a closed position and unseal the outlet in the second upper chamber when the flap valve is in an open position.

2. The dual-chambered device of claim 1, wherein the at least one inlet includes a filter that prevents nonliquid materials from entering the first lower chamber.

3. The dual-chambered device of claim 1, wherein the first lower chamber is in fluid communication with the second upper chamber through a pipe that delivers liquid from the first lower chamber to the second upper chamber when a pressure in the second upper chamber drops.

4. The dual-chambered device of claim 3, wherein the drop in pressure in the second upper chamber is created when the flap valve is in an open position and the liquid in the second upper chamber is released.

5. The dual-chambered device of claim 1, wherein the float is configured to open the flap valve when the level of liquid in the first lower chamber is at or exceeds a determined level and wherein the float is configured to close the flap valve when the level of liquid in the first lower chamber does not exceed the determined level.

6. The dual-chambered device of claim 1, wherein the second upper chamber is made from a transparent material so that the amount of liquid retained in the second upper chamber may be observed from outside the dual-chambered device.

7. The dual-chambered device of claim 1, further comprising:

one or more support arms secured to the dual-chambered device that extend away from the dual-chambered device to maintain the dual-chambered device in an upright position and to create channels through which liquid from the nonporous surface is directed toward the dual-chambered device.

8. The dual-chambered device of claim 1, wherein the second upper chamber is configured to retain an amount of liquid that acts as a weight to create a depression on the nonporous surface and that attracts liquid from the nonporous surface.

* * * * *